US005319902A

United States Patent [19]

Seppa

[11] Patent Number: 5,319,902

[45] Date of Patent: Jun. 14, 1994

[54] MASS TOWER AND METHOD OF MAKING THE SAME

[75] Inventor: Ilkka Seppa, Marietta, Ga.

[73] Assignee: A. Ahlstrom, Noormarkku, Finland

[21] Appl. No.: 713,816

[22] Filed: Jun. 12, 1991

[51] Int. Cl.[5] ..... E04B 1/00; E04H 7/00

[52] U.S. Cl. ..... 52/741; 52/745.01; 52/743; 52/197; 162/52; 162/246; 162/18

[58] Field of Search ..... 52/197, 196, 195, 192, 52/741.1, 743, 745.01; 162/52, 18, 247, 246, 249

[56] References Cited

U.S. PATENT DOCUMENTS

| | | | |
|---|---|---|---|
| 2,410,338 | 10/1946 | Craine | 52/197 |
| 2,899,884 | 8/1959 | Herbruck | 52/197 |
| 3,071,061 | 1/1963 | Collings et al. | 52/197 |
| 3,081,820 | 3/1963 | Schnyder | 162/246 |
| 3,551,285 | 12/1970 | Lang | 162/249 |
| 3,902,962 | 9/1975 | Reinhald | 162/246 |
| 3,926,814 | 12/1975 | Hogarth | 52/197 |
| 4,028,171 | 6/1977 | Richter | 162/246 |
| 4,065,891 | 1/1978 | Burgin | 52/197 |
| 4,105,494 | 8/1978 | Pettersson | 162/52 |
| 4,161,421 | 7/1979 | Sherman | 162/52 |
| 4,606,158 | 8/1986 | Krauss | 52/192 |
| 5,120,398 | 6/1992 | Henricson et al. | 162/52 |

*Primary Examiner*—Carl D. Friedman
*Assistant Examiner*—Winnie Yip
*Attorney, Agent, or Firm*—Cohen, Pontani, Lieberman, Pavane

[57] ABSTRACT

A mass tower for medium or high consistency fiber suspension includes a vertically elongated circumferential side wall defining a space for receiving the fiber suspension. The bottom portion of the mass tower is filled with a material in an amount and of sufficient strength, preferably sand, gravel or concrete, to support the weight of the fiber suspension above the filling material. The filling material forms a bottom surface in contact with the fiber suspension and has an opening therein. Within the filling material is formed a flow channel in communication with the opening and extending through the filling material towards the side of the bottom portion for allowing the fiber suspension to be discharged from the mass tower. A method of manufacturing a mass tower and a method of converting an existing mass tower is also disclosed.

5 Claims, 5 Drawing Sheets

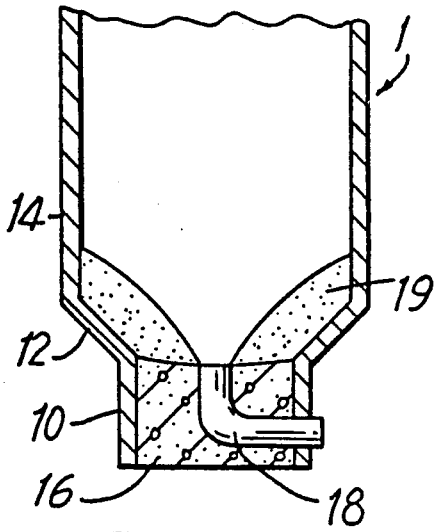
FIG. 1
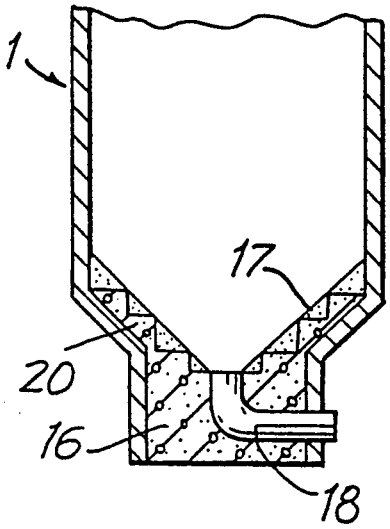
FIG. 2
FIG. 3
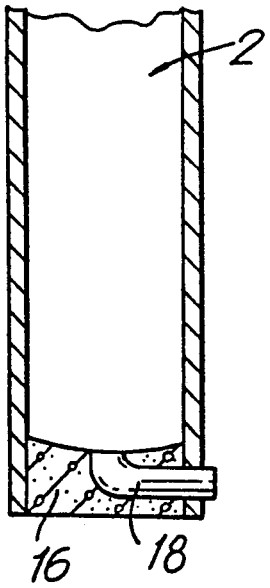
FIG. 4
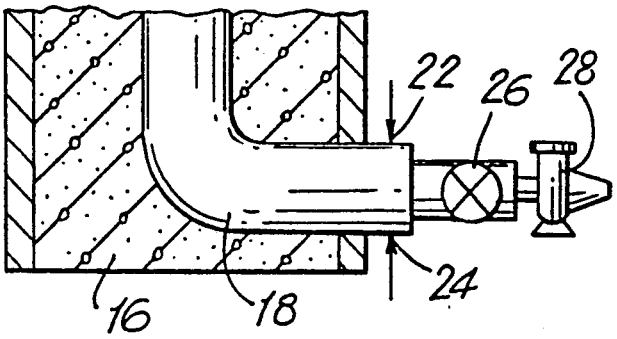

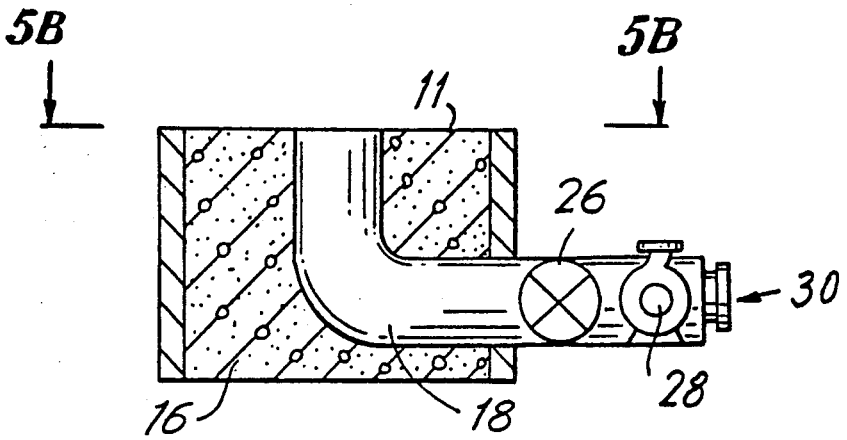
FIG. 5A
FIG. 5B
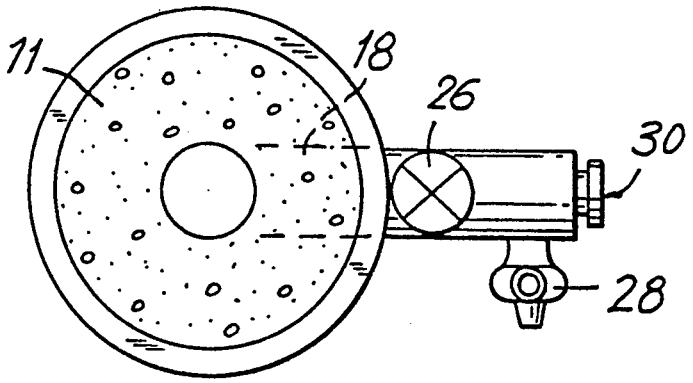

MASS TOWER AND METHOD OF MAKING THE SAME

FIELD OF THE INVENTION

The present invention relates to mass towers for bleaching or storing fiber suspensions of the pulp and paper industry. The invention also relates to the conversion of conventional mass towers used for storing or bleaching low consistency pulp, so as to enable these towers to handle medium or high consistency pulp.

BACKGROUND OF THE INVENTION

Mass towers of older construction are designed so that the pulp is, at least when discharged, of low consistency i.e. below about 5%. The pulp stored in the tower either has a consistency which is sufficiently low so that the pulp can be discharged entirely by conventional means or, if initially at higher consistency, the pulp is diluted in the bottom part of the tower to a lower consistency so that, in either case, the pulp can be pumped by a conventional low consistency pump arranged at the side wall of the bottom part of the mass tower. Therefore, the tower has conventionally been constructed and arranged so that the bottom of the tower rests directly on the ground and the pumps have been installed on the same ground level. Such a structure is naturally advantageous as the entire weight of the tower and pulp contained therein is evenly distributed over the entire area of the tower bottom.

To convert the known "low consistency" towers to meet the demands of modern medium consistency technology, one must take into account that medium or high consistency pulp is generally discharged through the bottom of the respective tower. The term medium or high consistency pulp refers to pulp having a consistency above 6% and preferably up to 10% or higher. Therefore, it is required to raise the bottom of the known tower to enable the installation of a pump underneath the tower bottom. Accordingly, there have been attempts to raise the tower bottom of a conventional mass tower so that a new bottom can be attached e.g. by welding, to the walls of the tower leaving a space for the pump and other required auxiliary equipment between the raised tower bottom and the ground level. However, such structures have not proved to be reliable, as the original walls of the tower are relatively thin and have not been designed to bear the additional stress due to the weight of the pulp when the tower has been raised. In other words, stiffening and reinforcing members must be installed to support the weight. Additional problems are caused by changes in the shape of the tower bottom due to both temperature changes and changes in the weight of the tower, as the pulp level in the tower may change to a great extent as the tower may at times be completely empty or it may be completely filled.

A very commonly used structure of a mass tower is one built up of concrete bricks. In this structure it is very difficult to install a raised steel bottom and to shape the same in any desired way. Also the space under the new steel bottom cannot be efficiently utilized due to structural demands which also add greatly to the expense of any structural modification.

SUMMARY OF THE INVENTION

The method and apparatus of the present invention minimize the above mentioned drawbacks by forming or shaping the bottom of the tower from concrete or some other suitable filler material and, if need be, to coat or cover the tower bottom with some appropriate coating material. For instance, the bottom portion of an old-fashioned low consistency tower is first filled with a filler material such as gravel or sand, the sand is thereafter compacted and provided with a suitable cover e.g. one made from steel. The discharge opening leading to the pumping arrangement may be located in the center of the tower bottom or any other location which is more preferably regarding the flow characteristics of both the tower structure and the type of pulp stored therein. The discharge opening of the tower bottom is connected to the pumping device via a flow channel which can now be directed towards the side of the tower. This channel may be made of concrete, steel, glassfiber or other suitable material which may be the same as or different from the filler material.

The design of the flow channel can be optimized with regard to the flow characteristics and manufacturing expenses. For instance, it may be a prefabricated steel pipe and positioned in the bottom of the tower prior to casting the filler material, for instance, concrete.

A shut-off valve, connections for chemicals, steam, dilution liquid, measuring equipment etc. may be provided in the portion of the flow channel extending outside the mass tower bottom, thereby also greatly facilitating the service of the auxiliary equipment.

Thus, a suitable pump, as further described below, may be connected to the protruding flow channel in any desired position. A pump for pumping the pulp or fiber suspension may be located at the end of, at the side of, under or above the flow channel which protrudes from the tower. Any suitable pumping method or means for pumping medium or high consistency pulps may be chosen for example, a positive displacement pump and so-called MC® pump of the instant assignee may be used in any of the aforementioned positions.

In addition, any known tower bottom discharge devices may be used in connection with the present invention. For example, the shaft of a conventional bottom scraper may lead through the flow channel and the bearings therefor may be positioned at least partially at the discharge opening of the tower bottom. A screw arranged on the shaft of the bottom scraper facilitates the flow towards the pump arrangement thus permitting the discharge and the pumping of high consistency pulp.

Advantages of the present invention include:

Already existing pulp storage and bleaching towers are easily modified so that the pulp can be discharged therefrom at medium or high consistency.

The height of new storage towers can be decreased, resulting in substantial savings of construction costs.

The present invention enables the simple and low cost construction of various sizes and shapes of mass towers.

The weight of the tower and the pulp contained therein is distributed over the entire cross-sectional area of the tower.

Also, the bottom of the tower is not sensitive to temperature fluctuations and changes in the weight of the tower content.

A shut-off valve can be provided in connection with the flow channel for facilitating the service and maintenance of the tower and equipment associated therewith.

Preferably, the flow channel is of a material that withstands the chemicals customarily used in the pulp and paper industry.

Also, connections for, for instance, steam-heating, can also be provided at the tower as well as at the flow channel, the size and the shape of which may also be chosen for each individual application.

BRIEF DESCRIPTION OF THE DRAWINGS

These and other objects will become more apparent after referring to the following specification and attached drawings, in which:

FIG. 1 is a cross-sectional view of a first embodiment of the present invention;

FIG. 2 is a cross-sectional view of a further embodiment of the present invention;

FIG. 3 is a cross-sectional view of yet another embodiment of the present invention;

FIG. 4 is a fractional enlarged view, partially in cross-section, of the present invention;

FIG. 5A is a fractional view, partially in cross-section, of the present invention;

FIG. 5B is a cross-sectional view along the lines 5B—5B of FIG. 5A;

DETAILED DESCRIPTION OF THE PRESENTLY PREFERRED EMBODIMENTS

Figure 6:
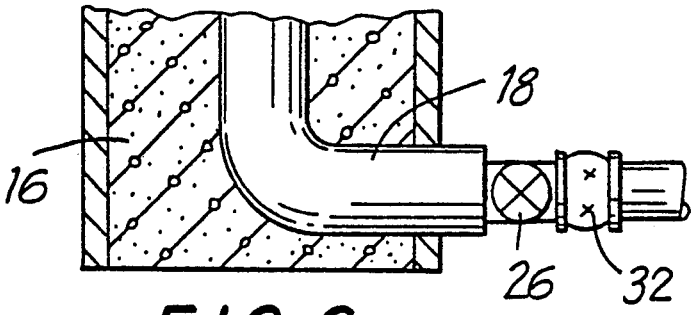
FIG. 6 is a fractional view, partially in cross-section, of another embodiment of the present invention.

FIG. 1 illustrates a vertical mass tower having a lower substantially cylindrical portion 10, an outwardly tapering portion 12 and a wider, substantially cylindrical, upper portion 14. In known applications, the lower portion 10 of the tower is utilized to discharge the pulp by arranging the centrifugal pump at the vertical side wall with or without prior diluting the thicker pulp to a lower consistency for pumping as explained above. The dilution liquid is mixed with the pulp by means of a known specially designed mixer (not shown) arranged in said lower portion 10 of the tower 1.

In accordance with the present invention the lower portion 10 of the tower 1 is filled with an appropriate material, such as concrete 16, gravel, sand or the like. Prior to filling the bottom part of the tower with concrete or other suitable material, a curved flow channel 18 is installed and set in position within the bottom portion of the tower 1. Of course, it is also possible to use a mold in place of a flow channel, which mold may be removed after forming of the bottom portion.

The bottom surface 11 of the mass tower in accordance with the present invention may be the concrete surface as cast or depending on the intended use of customary chemicals, the bottom surface may be coated with a suitable material or covered with a resistant material such as steel. It is thus understood that the term "bottom surface" in this application refers to the surface contacting the fiber suspension stored in the tower which surface may be formed by and actually be part of the filler material or may be from a material different from the filler material or other suitable means for supporting said surface in accordance with the present invention. The supporting structures may also differ in height such as, for example, increasing in height toward the circumference or in an outwardly radial direction from the middle of the tower such as to locate the opening into the discharge channel at the lowest point.

FIG. 2 illustrates a mass tower 1 in accordance with the present invention, wherein the bottom is provided with built-in, or pre-cast, means 20 for facilitating the pulp flow in a downward direction. Such means may be a plurality of steps as illustrated or some other suitable means such as a concavely or convexly shaped surface.

The stepped tower bottom narrows down toward the discharge opening. In conventional hemispherically shaped tower bottoms or pressure vessel end designs a so-called "dead zone" (see 19 in FIG. 1) is created around the discharge opening in which zone the pulp does not flow but remains more or less stationary. In FIG. 2 the tower bottom is constructed so as to form a stepwise reduction preferably at least approximating the borderline of the dead zone schematically shown as 19 in FIG. 1.

The stepped tower bottom thus greatly reduces the amount of pulp 17 which otherwise remains in the dead zone and also permits to shape the tower bottom in accordance with the flow characteristics of the stored pulp, if desired.

FIG. 3 illustrates another embodiment in which the mass tower 2 has a uniform diameter, and wherein the bottom portion is filled with filler material to form the tower bottom including the flow channel 18.

FIG. 4 is an enlarged view of the end of the flow channel 18 protruding beyond the tower for providing connections for steam 22 and chemicals 24 upstream of the shut-off valve 26 and the pump 28.

FIG. 5A illustrates another embodiment, where a manhole 30 for mounting suitable auxiliary equipment has been arranged at the end of the flow channel 18 and the pump 28 is mounted at the side of the flow channel 18.

FIG. 5B shows a cross-sectional view along the line 5B—5B of FIG. 5A with flow channel 18 at the center of the mass tower in the bottom surface 11 and the pump 28 mounted onto the protruding flow channel perpendicular to the axes thereof.

Figure 7:
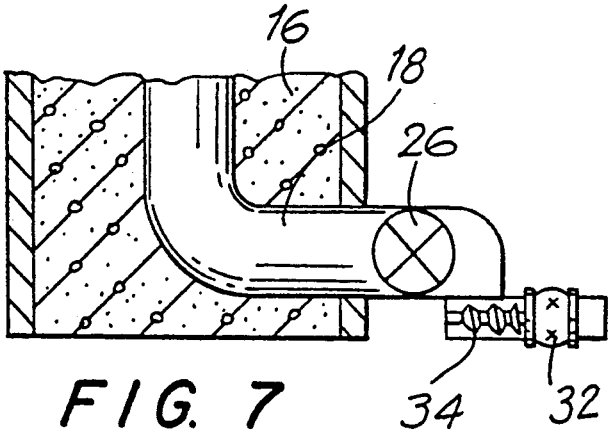
FIG. 7 is a fractional view, partially in cross-section, of yet a further embodiment of the present invention.
Figure 8:
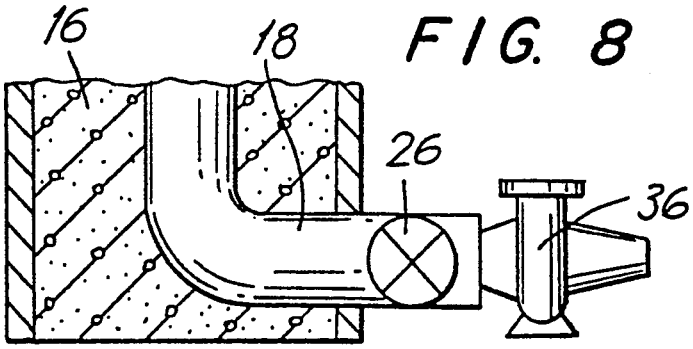
FIG. 8 is a fractional view, partially in cross-section, of yet another embodiment of the present invention.

As already stated, different types of commercially available high consistency pumps may be used, in connection with the present invention, such as, for example, a so-called Kamyr pump 32 shown by way of example in FIGS. 6 and 7. The pump 32 shown is a positive displacement type pump having two intermeshing rotors and is used either alone (FIG. 6) or in combination with a feeder screw 34 (FIG. 7). Also a modern medium consistency pump, so-called MC® pump 36 may be used (FIG. 8).

Figure 9A:
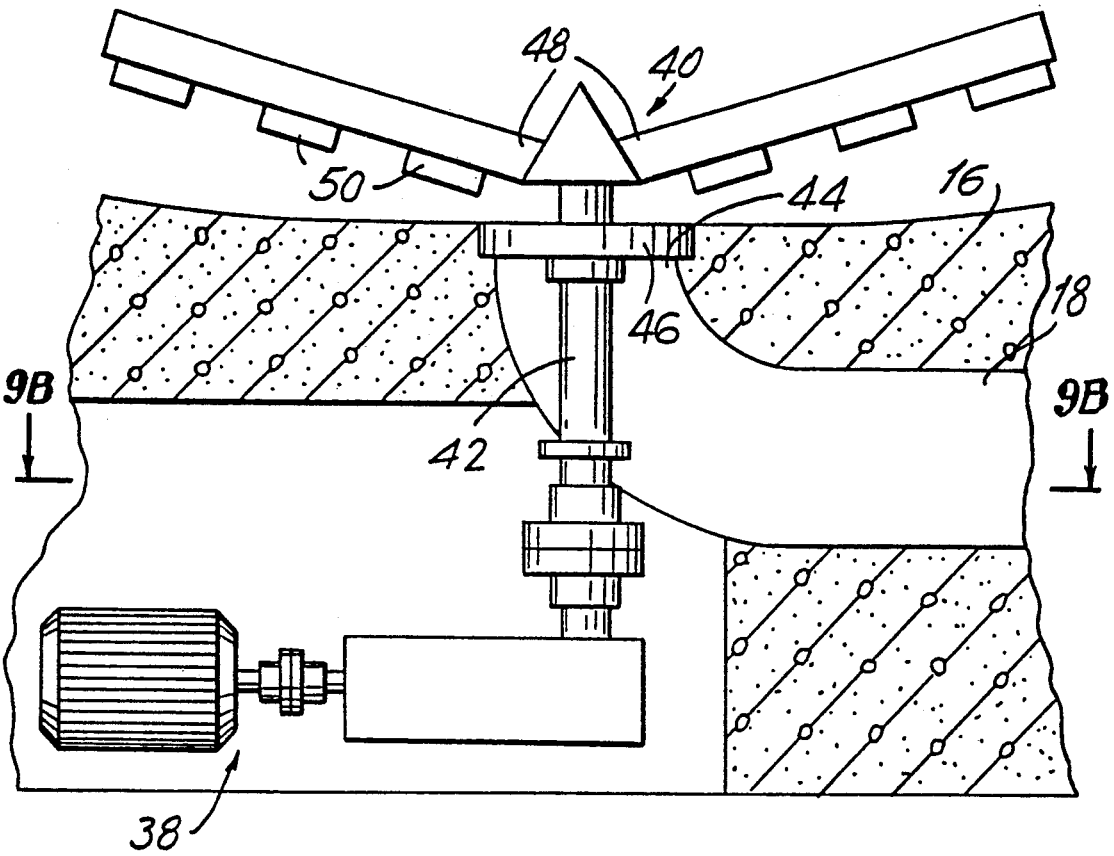
FIG. 9A is an enlarged fractional view, partially in cross-section of yet a further embodiment of the present invention.
Figure 9B:
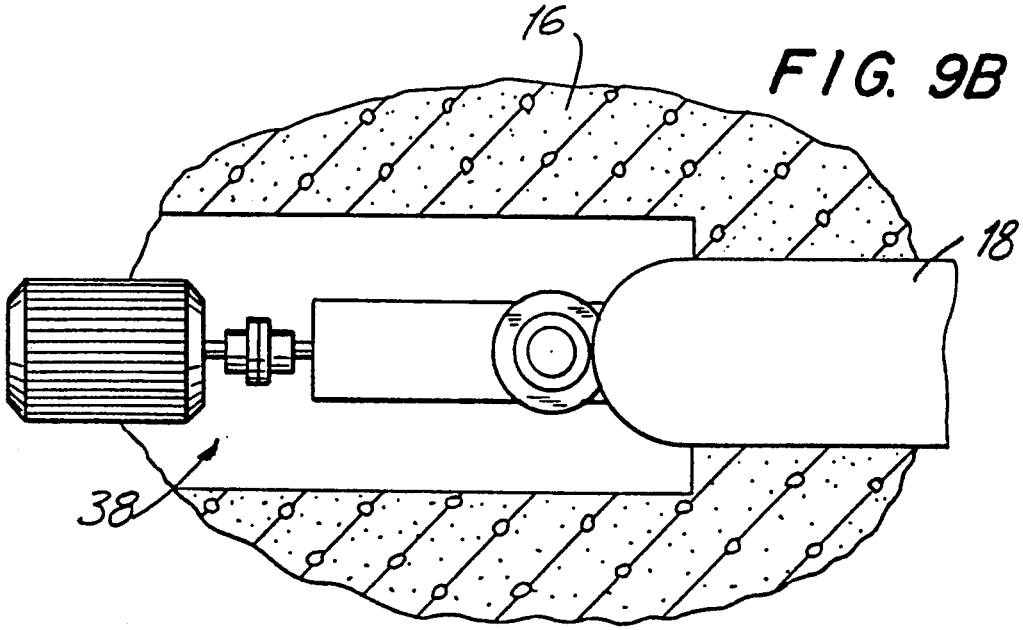
FIG. 9B is an enlarged cross-sectional view, partially plain view, along the lines 9B—9B of FIG. 9A.

FIGS. 9A and B illustrate a further embodiment including a more detailed structure of the tower discharge system. On the ground level G in an open space within the cast tower bottom 16 there is arranged a drive means 38, such as an electric motor, for rotating the bottom scraper 40 within the tower. The scraper 40 is connected to the drive means 38 by a shaft 42 extending through the discharge opening 44. The shaft 42 is supported by a bearing unit 46. The scraper 40 is provided, in this embodiment, with two arms 48, each arm carrying three blades 50. Upon rotation of the scraper the blades 50 feed the pulp towards the discharge opening 44.

Figure 10:
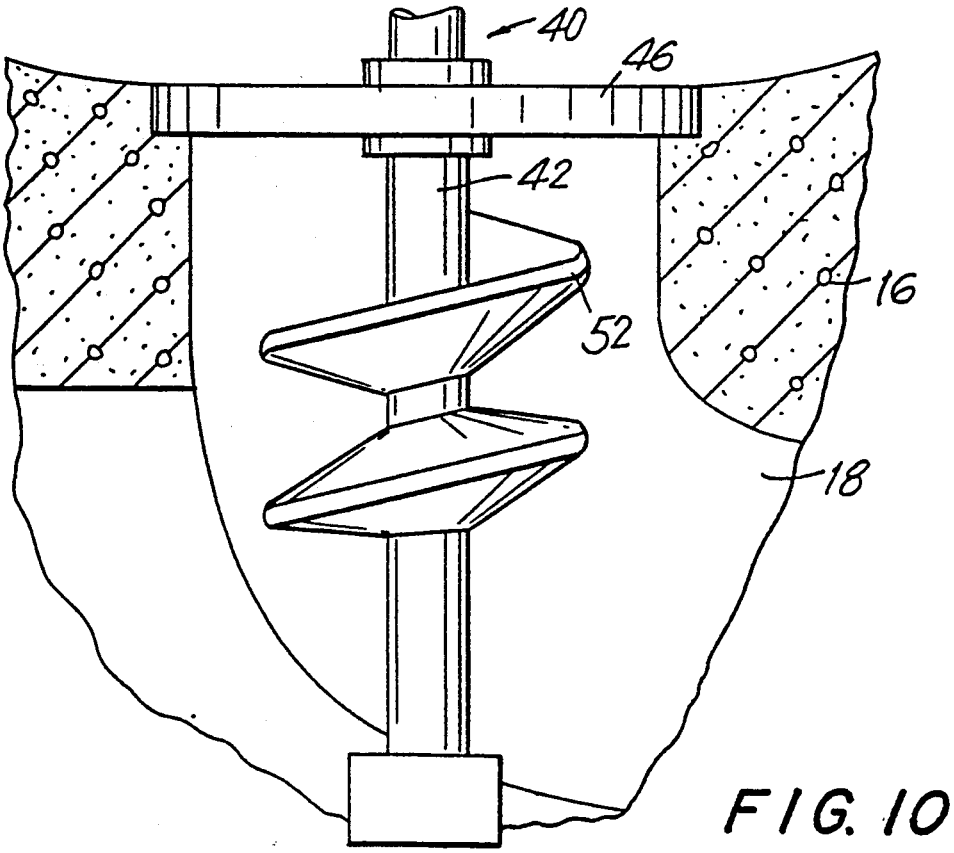
FIG. 10 is an enlarged fractional view of the flow channel of the present invention.

FIG. 10 shows a further embodiment of the present invention wherein the shaft 42 of the bottom scraper 40 is provided with a screw feeder 52 located within the flow channel underneath the bearing unit 46 for facilitating the pulp flow towards the pumping device.

Figure 11:
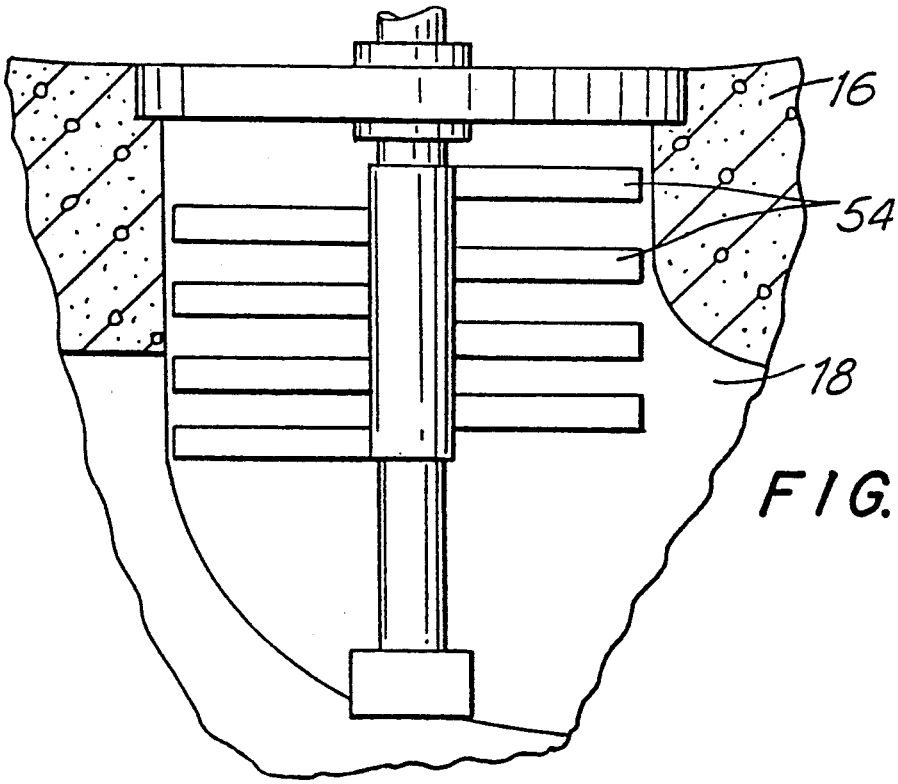
FIG. 11 is a fractional enlarged view of yet another embodiment of the flow channel of the present invention.

FIG. 11 shows another feeder structure located in the flow channel and formed of a number of inclined blades 54 for feeding the pulp through the flow channel.

To further facilitate the pulp flow towards the pumping device, the cross-sectional area of the flow channel 18 may increase in the flow direction, thus enabling pulp of even higher consistency to flow through the channel.

It should be understood that the preferred embodiments and examples described are for illustrative purposes only and are not to be construed as limiting the scope of the present invention which is properly delineated only in the appended claims.

What is claimed is:

1. A method for converting a mass tower used for handling low-consistency fiber suspension into one for handling medium or high-consistency fiber suspension, said mass tower for low-consistency fiber suspension being formed of a lower portion defined by a lower circumferential upright side wall having a first diameter and a first height and an upper portion defined by an upper upright circumferential wall having a second diameter placed on said lower portion by means of an outwardly tapering portion connecting said upper and lower portions, the first diameter being substantially smaller than the second diameter, the method of comprising the steps of:

installing in said lower portion a flow channel for said medium or high-consistency fiber suspension, said flow channel having a first end extending vertically to a second height and, when in operation, communicating with said medium or high-consistency fiber suspension contained in said tower so said medium or high-consistency fiber suspension will flow into said flow channel and a second end extending through said side wall of said lower portion for permitting said medium or high-consistency fiber suspension to be discharged from the tower; and filing said lower portion substantially up to said second height with a material in an amount and of sufficient strength to support said medium or high-consistency fiber suspension in said tower, said second height substantially equalling the first height so that said flow channel is embedded in said material.

2. The method of claim 1, wherein said material has a top surface so as to enhance the flow of said fiber suspension into said flow channel.

3. The method of claim 2, wherein said lower portion is filled with said material selected from the group consisting of concrete, sand and gravel, and, comprising the additional step of compacting said material to form a solid base for said mass tower; and covering said top surface formed from said material with a second surface.

4. The method of claim 3, wherein said second surface is a steel surface.

5. The method of claim 1, wherein said lower portion filling material is concrete.

* * * * *